US009833696B2

(12) United States Patent
Brown

(10) Patent No.: US 9,833,696 B2
(45) Date of Patent: Dec. 5, 2017

(54) LOCKABLE WAGERING CHIP CONTAINER AND METHOD FOR USING THE SAME

(71) Applicant: Chip Locker LLC, Lake Forest, IL (US)

(72) Inventor: Eric Brown, Lake Forest, IL (US)

(73) Assignee: CHIP LOCKER LLC, Lake Forest, IL (US)

( * ) Notice: Subject to any disclaimer, the term of this patent is extended or adjusted under 35 U.S.C. 154(b) by 0 days.

(21) Appl. No.: 15/206,467

(22) Filed: Jul. 11, 2016

(65) Prior Publication Data

US 2017/0007918 A1 Jan. 12, 2017

Related U.S. Application Data

(60) Provisional application No. 62/191,112, filed on Jul. 10, 2015.

(51) Int. Cl.

| | |
|---|---|
| ***A63F 11/00*** | (2006.01) |
| ***E05B 35/00*** | (2006.01) |
| ***E05B 65/52*** | (2006.01) |
| *E05B 19/24* | (2006.01) |

(52) U.S. Cl.

CPC ..... *A63F 11/0002* (2013.01); *E05B 35/008* (2013.01); *E05B 65/52* (2013.01); *A63F 2011/0006* (2013.01); *E05B 19/24* (2013.01)

(58) Field of Classification Search

CPC ..... A47B 88/00; A47B 88/16; A63F 11/00; A63F 11/0002; A63F 2011/0006; B65D 25/10; B65D 85/00; B65D 85/57; E05B 19/24; E05B 35/008; E05B 65/46; E05B 65/52; A45C 13/10

USPC ..... 206/1.5, 38, 38.1, 303; 220/345.1–345.3, 220/346, 347; 70/63–77

See application file for complete search history.

(56) References Cited

U.S. PATENT DOCUMENTS

| | | | | |
|---|---|---|---|---|
| 3,888,350 | A * | 6/1975 | Horvath | B65D 11/12 220/345.3 |
| 5,213,209 | A * | 5/1993 | Song | G11B 33/0422 206/309 |
| 5,263,577 | A * | 11/1993 | Paratte | G04C 10/00 206/38.1 |
| 5,819,928 | A * | 10/1998 | Wynalda, Jr. | G11B 33/0494 206/1.5 |
| 2004/0055903 | A1 * | 3/2004 | Nishimura | A45C 11/14 206/1.5 |

* cited by examiner

*Primary Examiner* — Bryon Gehman
(74) *Attorney, Agent, or Firm* — Troutman Sanders LLP

(57) ABSTRACT

A lockable wagering chip container is disclosed which includes a case, a drawer, and a lock mechanism. The case includes a case top, a case bottom, two case sides, and two case ends. The case top includes a through-hole and at least one of the two case ends is open. The drawer includes a drawer top, a drawer bottom, two drawer sides, and two drawer ends. The drawer bottom, two drawer sides, and two drawer ends partially enclose a drawer interior configured to hold a plurality of chips; the drawer top is open. At least one of the drawer ends includes a chip slot configured to accept a chip inserted when the drawer is in a closed position. The lock mechanism is positioned within the case and configured to secure the drawer in the closed position until the lock mechanism is released by a key inserted into the through-hole.

17 Claims, 10 Drawing Sheets

Basic Strategy (4-8 decks, dealer stays on soft 17)

| Player Hand | Dealer's face-up card | | | | | | | | | |
|---|---|---|---|---|---|---|---|---|---|---|
| Hand totals | 2 | 3 | 4 | 5 | 6 | 7 | 8 | 9 | 10 | A |
| 17-20 | S | S | S | S | S | S | S | S | S | S |
| 16 | s | s | s | s | s | H | H | SU | SU | H |
| 15 | s | s | s | s | s | H | H | H | H | H |
| 13-14 | s | s | s | s | s | H | H | H | H | H |
| 12 | H | H | S | S | S | H | H | H | H | H |
| 11 | Dh | Dh | Dh | Dh | Dh | Dh | Dh | Dh | Dh | H |
| 10 | Dh | Dh | Dh | Dh | Dh | Dh | Dh | Dh | H | H |
| 9 | H | Dh | Dh | Dh | Dh | H | H | H | H | H |
| 5-8 | H | H | H | H | H | H | H | H | H | H |
| Soft totals | 2 | 3 | 4 | 5 | 6 | 7 | 8 | 9 | 10 | A |
| A, 8-A, 9 | S | S | S | S | S | S | S | S | S | S |
| A,7 | S | Ds | Ds | Ds | Ds | S | S | H | H | H |
| A,6 | H | Dh | Dh | Dh | Dh | H | H | H | H | H |
| A, 4-A, 5 | H | H | Dh | Dh | Dh | H | H | H | H | H |
| A, 2-A, 3 | H | H | H | Dh | Dh | H | H | H | H | H |
| Pairs | 2 | 3 | 4 | 5 | 6 | 7 | 8 | 9 | 10 | A |
| A, A | SP | SP | SP | SP | SP | SP | SP | SP | SP | SP |
| 10, 10 | S | S | S | S | S | S | S | S | S | S |
| 9, 9 | SP | SP | SP | SP | SP | S | SP | SP | S | S |
| 8, 8 | SP | SP | SP | SP | SP | SP | SP | SP | SP | SP |
| 7, 7 | SP | SP | SP | SP | SP | SP | H | H | H | H |
| 6, 6 | SP | SP | SP | SP | SP | H | H | H | H | H |
| 5, 5 | Dh | Dh | Dh | Dh | Dh | Dh | Dh | Dh | H | H |
| 4, 4 | H | H | H | SP | SP | H | H | H | H | H |
| 2, 2-3, 3 | SP | SP | SP | SP | SP | SP | H | H | H | H |

S=Stand
H=Hit
SP=Split
Dh=Double (If not allowed, then hit)
Ds=Double (if not allowed, then stay)
SU=Surrender (if not allowed, then hit)

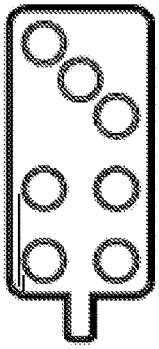

FIG. 12

LOCKABLE WAGERING CHIP CONTAINER AND METHOD FOR USING THE SAME

CROSS-REFERENCE TO RELATED APPLICATIONS AND PRIORITY CLAIM

This application claims the benefit of U.S. Provisional Patent Application No. 62/191,112 filed Jul. 10, 2015, entitled "Lockable Wagering Chip Container And Method For Using The Same." The foregoing patent application is hereby incorporated by reference into this application in their entireties

FIELD

This disclosure is directed to the field of aids for wagering. More specifically, the disclosure is directed to devices to discourage imprudent wagering.

BACKGROUND

Millions of consumers visit casinos every year to play table games. These games are designed to give the casino a statistical advantage. As a result, players are expected to lose a certain percentage of every dollar they wager over the long run. However, players often lose amounts that greatly exceed the mathematical disadvantage of these games. There are two primary reasons for the oversized losses, (1) players play the games poorly (i.e., do not follow the proper strategy); and (2) they do not play these games responsibly (e.g., over bet, fail to set and keep a budget, don't quit when they are winning).

Playing casino table games is a lot of fun. However, a combination of sophisticated psychological tricks used by casinos (e.g., no clocks, free drinks, and chips played instead of cash) and common mistakes made by players (e.g., playing too long, over betting and not quitting when ahead) result in many players losing more than they should when they gamble. With every advantage in the house's favor, gamblers need to play smart and responsibly if they want to exit the casino with cash in their pocket.

SUMMARY

This disclosure describes a lockable chip container, which is a tool to help level the playing field and provides a structured and repeatable process to play more responsibly and get better results. The chip container's compact, lightweight design makes it convenient to take it to the gaming tables. At the tables, the chip container organizes game play around the simple rule of banking winnings by depositing chips into the chip container as a player wins. Once deposited the chips are removed from play and can only be accessed by inserting a key and sliding out the chip tray. The strategy of protecting and removing winnings from play is simple to execute and has multiple benefits: (1) every chip removed from play decreases the amount of money a player can lose; (2) when winning, the amount of chips in play remains relatively constant, allowing players to follow a consistent game strategy and betting strategy; (3) length of playing time is reduced; and (4) the final action of players, removing chips from the chip container for cash at the casino cashier, is positive. This encourages responsible play and helps to limit poor decisions which are often triggered when the last player action is negative.

BRIEF DESCRIPTION OF THE DRAWINGS

FIG. 12 is a plan view of the bottom of the chip container, illustrating one ornamental embodiment, in accordance with the present disclosure.

DETAILED DESCRIPTION

To facilitate an understanding of the principals and features of the disclosed technology, illustrative embodiments are explained below. The components described hereinafter as making up various elements of the disclosed technology are intended to be illustrative and not restrictive. Many suitable components that would perform the same or similar functions as components described herein are intended to be embraced within the scope of the disclosed electronic devices and methods. Such other components not described herein may include, but are not limited to, for example, components developed after development of the disclosed technology.

It must also be noted that, as used in the specification and the appended claims, the singular forms "a," "an" and "the" include plural referents unless the context clearly dictates otherwise.

By "comprising" or "containing" or "including" is meant that at least the named compound, element, particle, or method step is present in the composition or article or method, but does not exclude the presence of other compounds, materials, particles, method steps, even if the other such compounds, material, particles, method steps have the same function as what is named.

It is also to be understood that the mention of one or more method steps does not preclude the presence of additional method steps or intervening method steps between those steps expressly identified. Similarly, it is also to be understood that the mention of one or more components in a device or system does not preclude the presence of additional components or intervening components between those components expressly identified.

Figure 1:
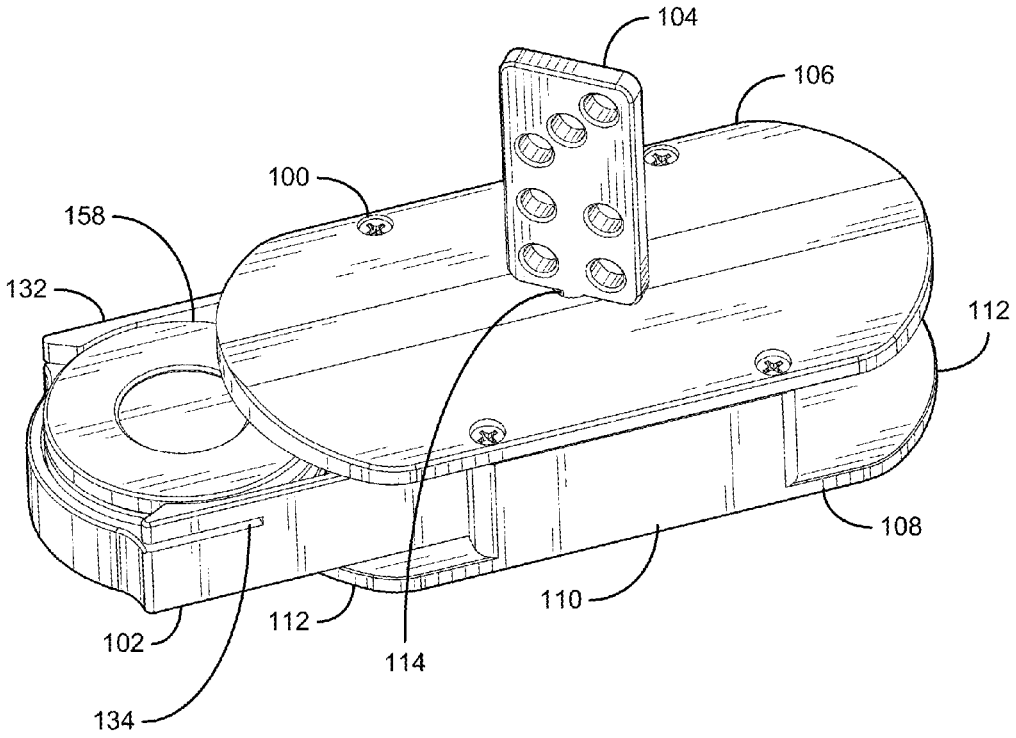
FIG. 1 is an isometric view of the chip container illustrating its ornamental design and major components, in accordance with the present disclosure.
Figure 2:
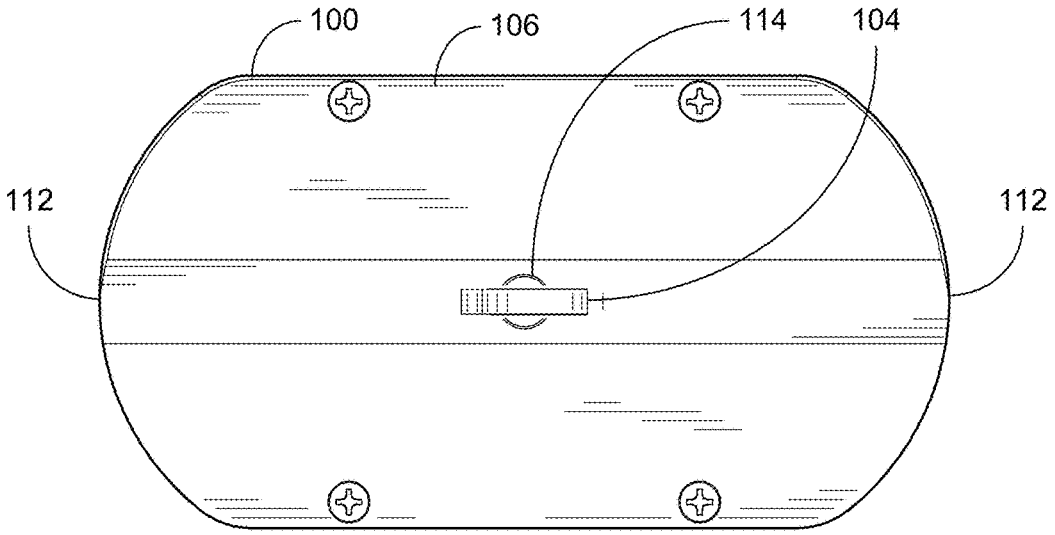
FIG. 2 is a plan view of the chip container illustrating its ornamental design and major components, in accordance with the present disclosure.
Figure 3:
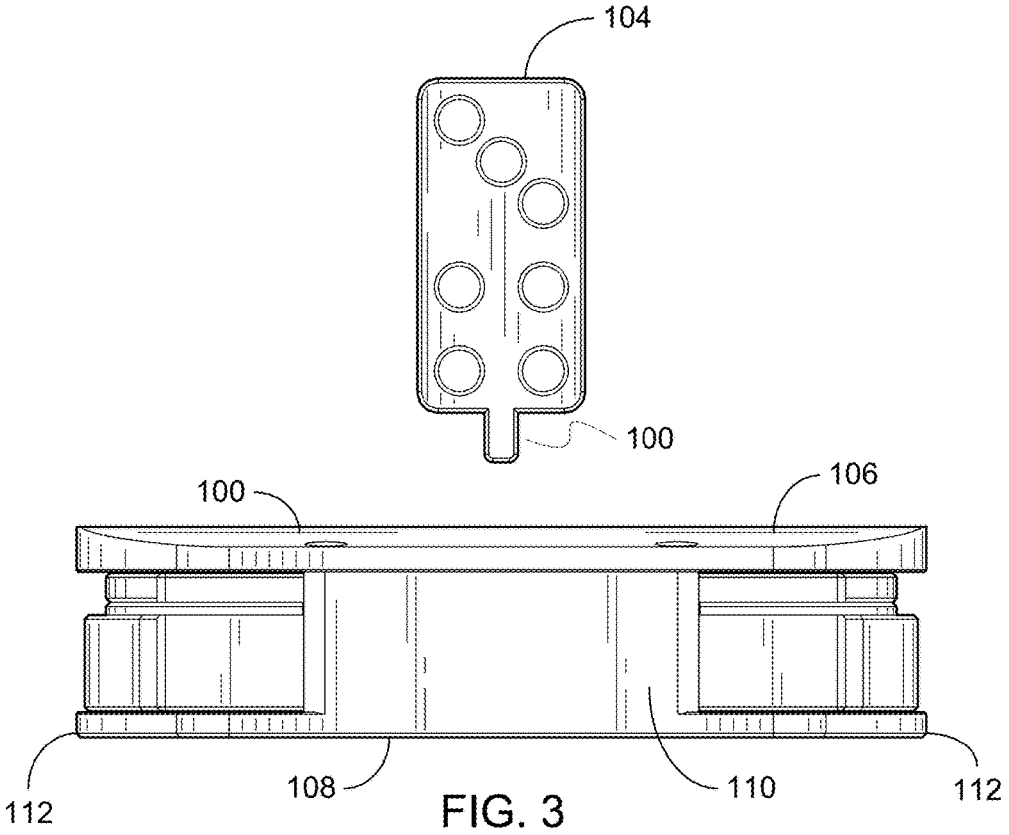
FIG. 3 is an elevation view of the side of the chip container illustrating its ornamental design and major components, in accordance with the present disclosure.
Figure 4:
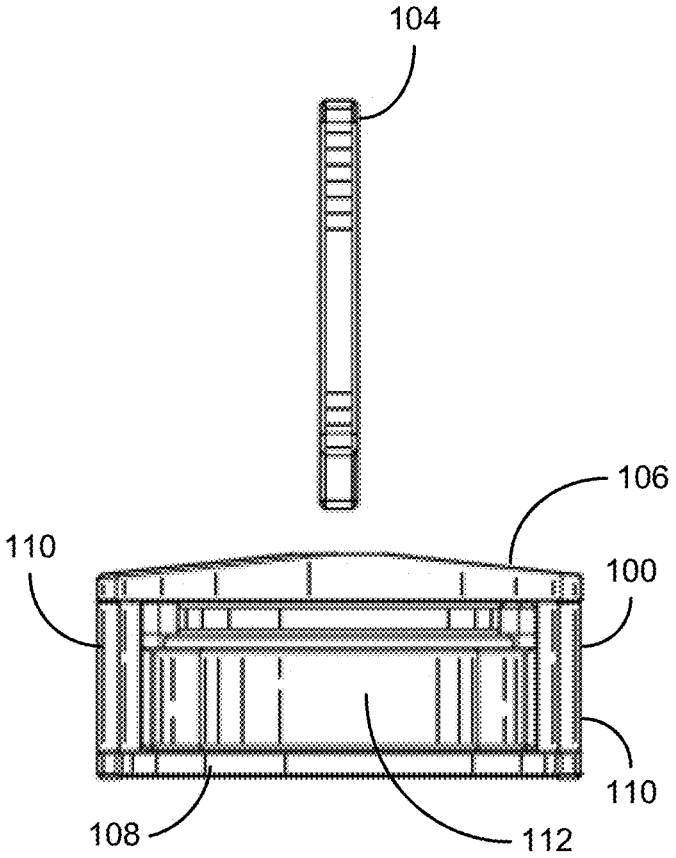
FIG. 4 is a plan view of the side of the chip container illustrating its ornamental design and major components, in accordance with the present disclosure.

Referring now to the Figures, in which like reference numerals represent like parts, various embodiments of the computing devices and methods will be disclosed in detail. FIG. 1 is an isometric view of the chip container, illustrating its ornamental design and major components. The chip container includes a case 100, a drawer 102, and a key 104. The case 100 has a top 106, a bottom 108, two sides 110, and two ends 112. The ends 112 are disposed along a longitudinal axis. The case 100 is open at both ends 112. The case 100 is closed on the sides 110 and on the bottom 108. The top 106 is closed except for one or more keyholes 114. The one or more keyholes 114 are proportioned to accept a key 104. In the preferred embodiment, the top 106 has a single keyhole 114. The top 106 may also include a decorative logo. The drawer 102 can slide longitudinally within the case 100 such that it can protrude from either end 112 of the case 100. When the drawer 102 is centered within the case 100, it does not protrude from either end 112. FIGS. 2-4 further illustrate the chip container's ornamental design and major components.

Figure 5:
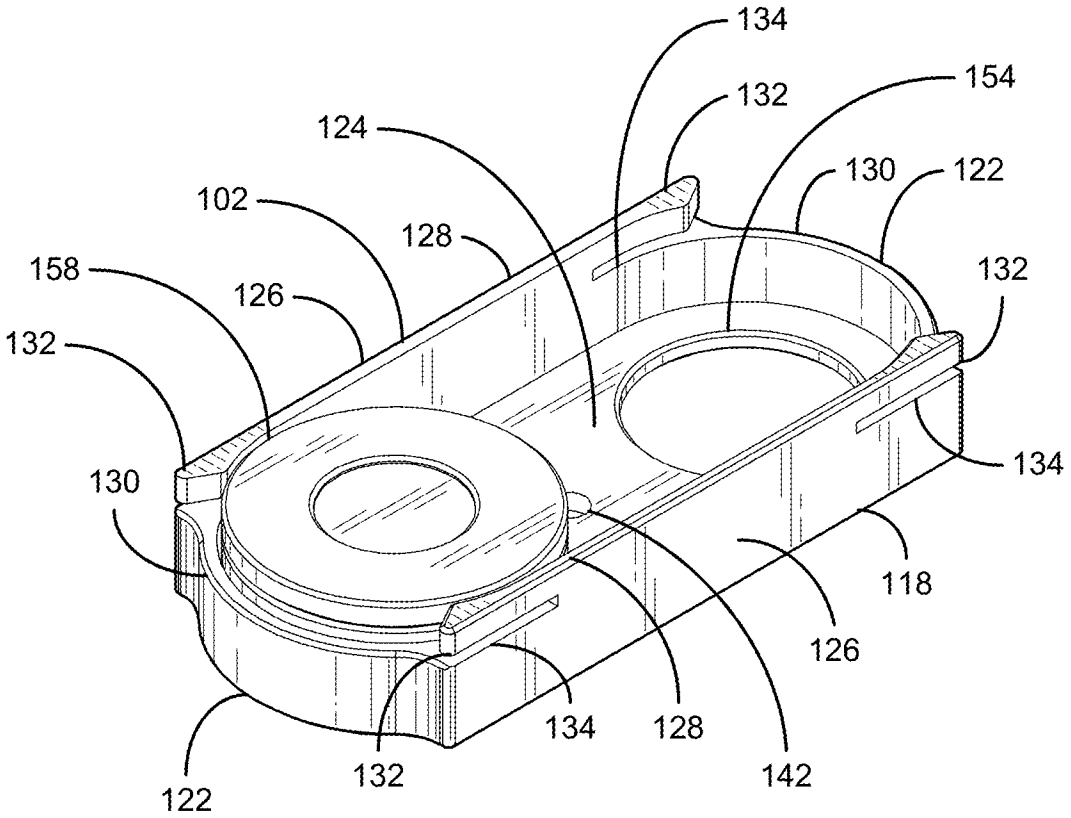
FIG. 5 is an isometric view of the drawer and one stack of chips, in accordance with the present disclosure.

FIG. 5 is an isometric view of the drawer 102 and one stack of chips 158. The drawer 102 has a drawer bottom 118, two drawer sides 120, and two ends 122, which partially enclose a drawer interior 124. The drawer sides 120 have a top edge 128. In the preferred embodiment, the drawer sides 120 are equally tall and their top edges 128 are parallel. The drawer interior 124 is sized to closely fit each chip 158, such as a poker chip. In some embodiments, the chips 158 may be a rectangle or a regular polygon, such as an octagon or a hexagon. In the preferred embodiment, the chips 158 are circular. Each end 122 of the drawer 102 includes an end wall 130, one or two fingers 132, and one or two slot 134*s*. In some embodiments, the end wall 130 may have a uniform thickness. In some of these embodiments, the uniform thickness of the end wall 130 may follow the contour of the chip 128. In other embodiments, the end wall 130 thickness may be non-uniform, to achieve a different external profile than the chip 128. For example, the drawer 102 may have rounded ends 122 even though it is designed to hold rectangular chips 158, or vice versa.

In the preferred embodiment, each drawer end 122 has two fingers 132 and two slots 134. The end wall 130 extends upward from the bottom 118 of the drawer 102 and is shorter than the top edge 128 of the tallest side 120 of the drawer 102 (if the sides have different heights). The height difference between the end walls 130 and side walls 126 of the drawer 102 allows a chip 158 to be inserted into the container between the top of the end wall 130 and the top 106 of the case 100 when the drawer 102 is closed. Each of the fingers 132 protrudes from one of the drawer sides 120, above the end wall 130 and separated from the end wall 130 by the slot 134.

For ends 122 that have two fingers 132, the narrowest distance between the fingers 132 is less than the smallest width of a chip 158. For example, the narrowest distance between the fingers 132 would be smaller than the short side of a rectangle, smaller than the width between the facets of an octagon, or smaller than the diameter of a circular chip 158. Because the drawer 102 is sized to closely fit a chip 158, this means that narrowest distance between the fingers 132 is also less than the interior width between the sides 120 of the drawer 102. For ends 122 that have a single finger 132, the narrowest distance between the finger 132 and the opposite side/end wall 126/130 is also less than the smallest cross-sectional width of a chip 158.

When a chip 158 is inserted into the chip container past the finger 132, the finger 132 flexes because the gap between the fingers 132 (or between the finger 132 and a side 120 of the drawer 102) is smaller than the chip 128. Then the chip 158 is inserted past the finger 132(*s*) it drops into the interior 124 of the drawer 102, unless there is only room for one more chip 158, in which case 100 it sits atop the stack of chips 158. In the preferred embodiment, inserting a chip 158 past the finger 132(*s*) also causes and audible "click," which reinforces the psychological feedback of banking one's winnings.

The finger 132 can flex independently of the drawer side walls 120 and end walls 130 of the drawer 102 because of the slot 134. The fingers 132 are proportioned so that this flexing will not cause permanent deformation of the fingers 132. In the preferred embodiment, the fingers 132 are also proportioned so that this flexing does not cause mechanical fatigue failure in the finger 132 material. In some embodiments, the fingers 132 may have a constant cross section. In certain other embodiments, the cross section of the fingers 132 may be variable. In some embodiments, the cross section of the fingers 132 may become narrower as the finger 132 extends from the side wall 120 of the drawer 102. In other embodiments, the cross section of the fingers 132 may become narrower as the finger 132 extends from the side wall 120 of the drawer 102. In still other embodiments, the cross section of the fingers 132 may alternate from narrower to thicker as the finger 132 extends from the side wall 120 of the drawer 102. For example, the finger 132 may have a thin section in one spot to promote flexion and a thicker section at its end, to create the correct size gap.

The drawer 102 also includes a guide-pin hole 142 and two or more extraction holes 154 in its bottom 118. The guide-pin hole 142 is positioned near the center of the bottom 118 of the drawer 102. The guide-pin hole 142 is proportioned to allow a guide pin 148 to pass through it. In the preferred embodiment, the guide pin 148 is cylindrical. The extraction holes 154 are positioned near the ends 122 of the drawer 102. The extraction holes 154 are sized to be smaller than a chip 158, so that a chip 158 cannot pass through them, but large enough for an object or finger to pass through. Therefore, when an end 122 of the drawer 102 is protruding from the end 112 of the case 100, the object or finger can be forced through the extraction hole 154, causing any chips 158 stored in the drawer 102 above the extraction hole 154 to be ejected from the open top of the drawer 102.

Figure 6:
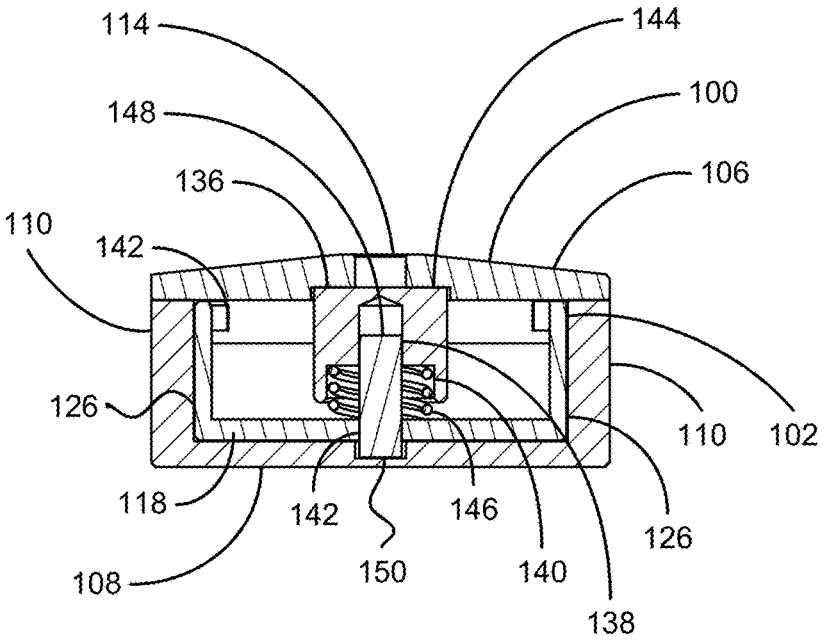
FIG. 6 is a cross-section view of the chip container illustrating the components of the locking mechanism in the locked position, in accordance with the present disclosure.
Figure 7:
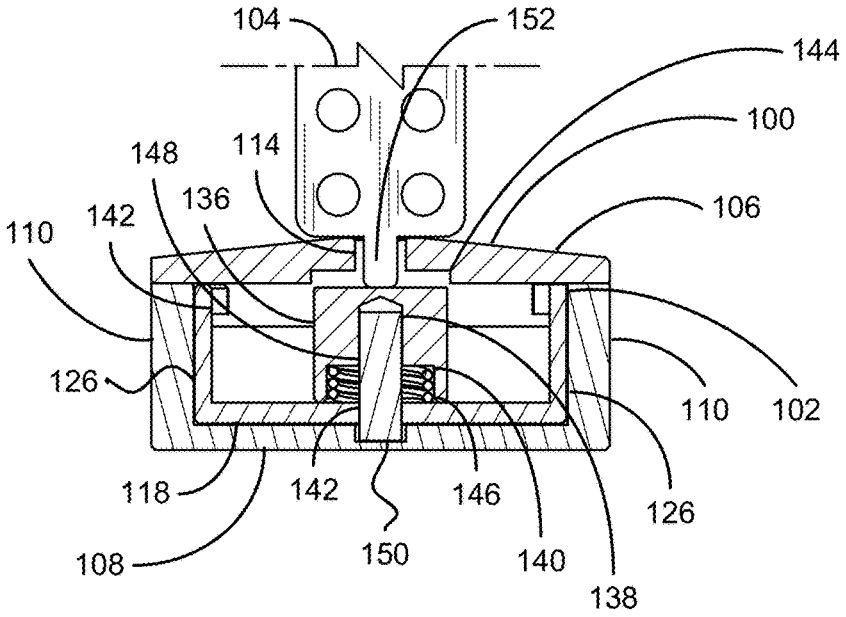
FIG. 7 is a cross-section view of the chip container illustrating the key 104 and the components of the locking mechanism in the un-locked position, in accordance with the present disclosure.

FIGS. 6 and 7, illustrate cross sections of the locking mechanism in the locked and un-locked positions, respectively. The locking mechanism includes a plunger 136, a spring 146, a guide pin 148, and a pocket 144 in the top 106 of the case 100. The guide pin 148 is mounted in a guide-pin hole 142 in the bottom 118 of the drawer 102. The guide pin 148 extends through the guide-pin hole 142 into a guide slot 150 in the bottom 108 of the case 100. In the preferred embodiment, the length of the guide-pin slot 150 is shorter than the length of the case 100. Thus, the interaction of the guide pin 148 and the guide-pin slot 150 prevents the drawer 102 from being fully removed from the case 100 in either direction.

The plunger 136 slides up and down the guide pin 148 on a plunger guide hole 138. The spring 146 is installed in a pocket 140 in the bottom of the plunger 136. The spring 146 is captured by the bottom 118 of the drawer 102 and exerts an upward force on the plunger 136. In the locked position, the spring 146 forces the plunger 136 into the pocket 144 in the top 106 of the case 100. Thus, when the plunger 136 is inserted in the pocket 144, the drawer 102 cannot be slid open in either direction because the plunger 136 immobilizes the guide pin 148 which in turn immobilizes the drawer 102.

The drawer 102 is unlocked by inserting the tip 152 of the key 104 into the keyhole 114 in the top 106 of the case 100 and applying downward force against the plunger 136. When enough force is applied, the plunger 136 disengages from the pocket 144 and the drawer 102 can be slid open. In the preferred embodiment, the keyhole 114 is cylindrical and the tip 152 of the key 104 is rectangular and small enough to be inserted into the keyhole 114. However, persons having ordinary skill in the art will understand that other key 104 and keyhole 114 embodiments are possible. For example, the tip 152 of the key 104 and the keyhole 114 may both be cylindrical, may both be rectangular, or may be any other combination of common geometrical shapes where the tip 152 of the key 104 can be inserted into the keyhole 114. If greater security is desired, the tip 152 of the key 104 and the keyhole 114 can have more complex shapes. For example, and not in limitation, the key 104 and keyhole 114 could both be "L" shaped, "keyhole" shaped, or "sawtooth" shaped. Furthermore, addition keyholes 114 and key 104 tips 152 could increase security. For example, and not in limitation, an embodiment might have two holes (e.g. "spanner drive" holes), requiring two pin-shaped tips on the key. In further embodiments, the pin-shaped tips may be different lengths or diameters, with matching features in the keyholes 114 and/or the plunger 136.

Figure 8:
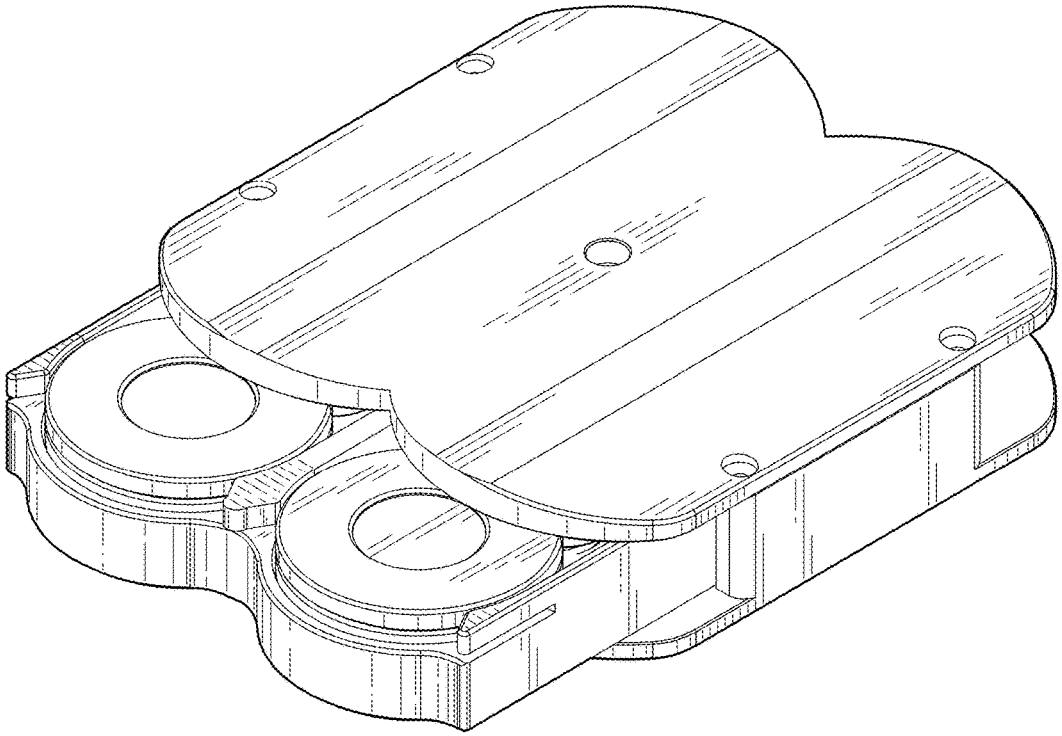
FIG. 8 is an isometric view of the chip container illustrating an alternative embodiment having 4 chip stacks in a two-by-two configuration, in accordance with the present disclosure.
Figure 9:
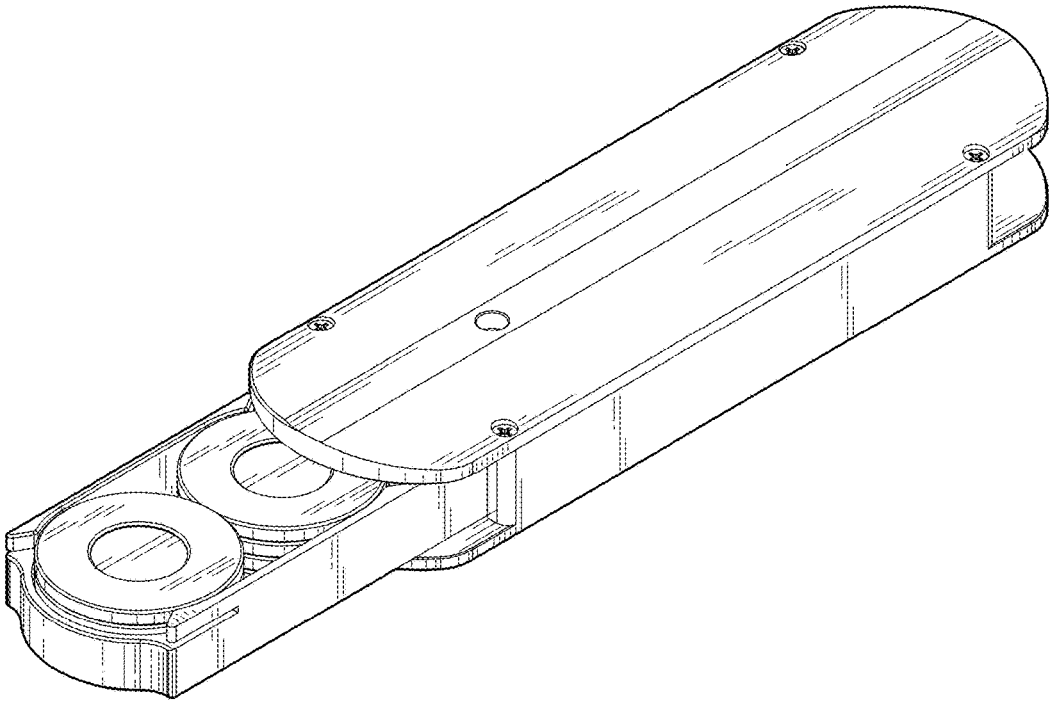
FIG. 9 is an isometric view of the chip container illustrating an alternative embodiment having 4 chip stacks in an in-line configuration, in accordance with the present disclosure.
Figure 10:
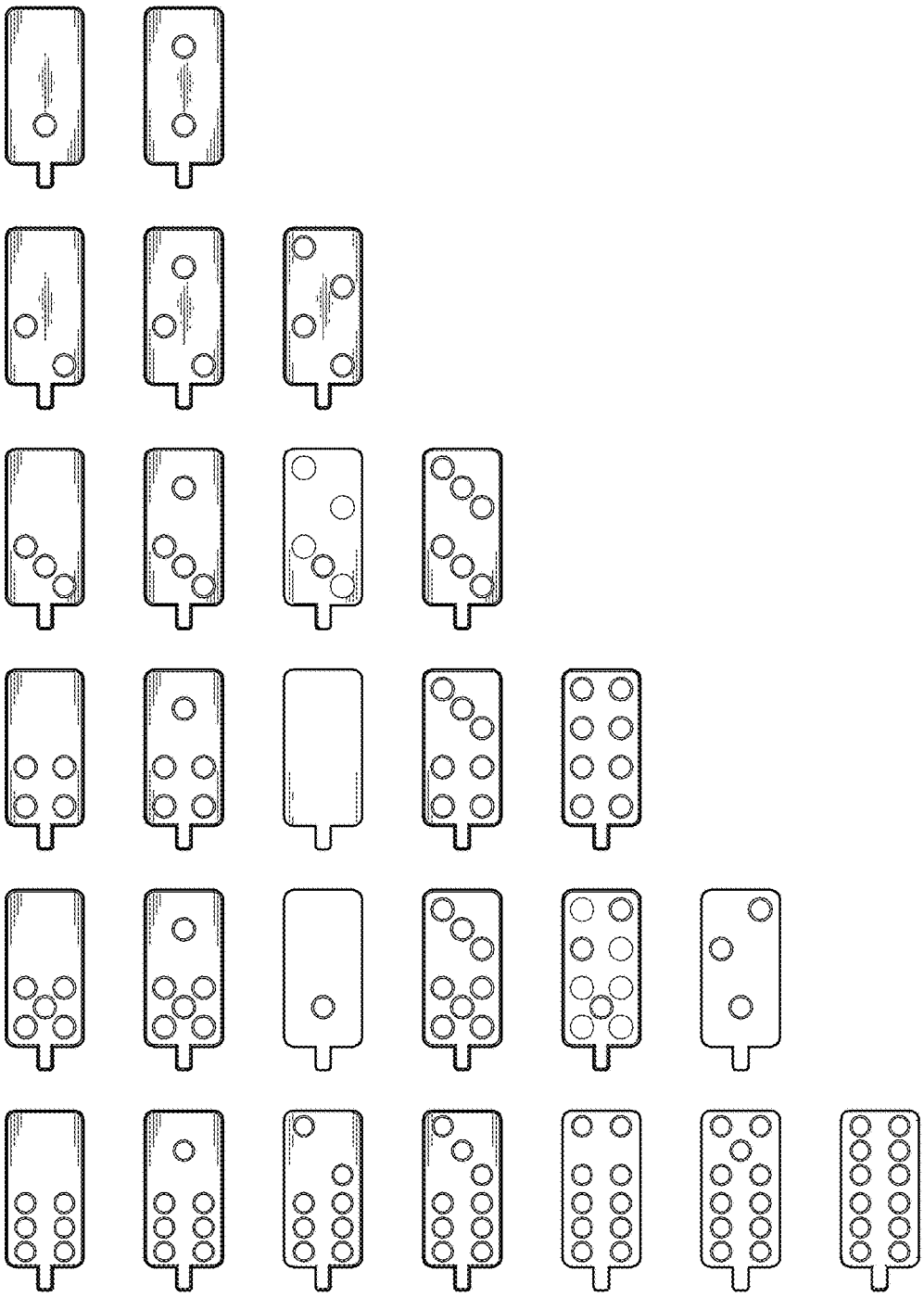
FIG. 10 is a plan view illustrating alternative embodiments of the ornamental design of the key.
Figure 11:
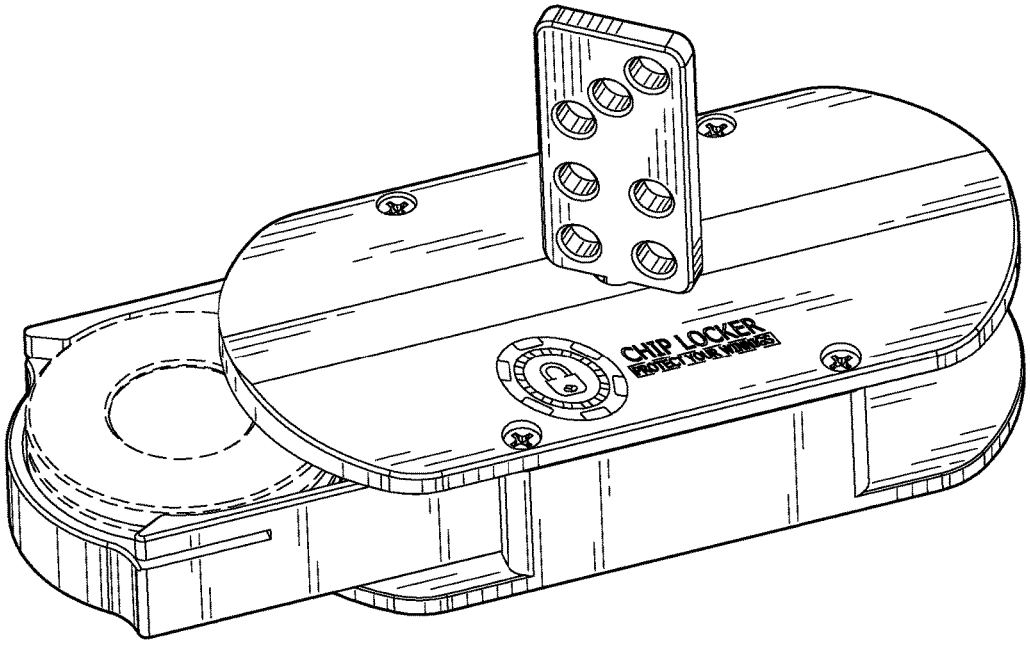
FIG. 11 is an isometric view of the chip container, illustrating one ornamental embodiment, in accordance with the present disclosure.

FIG. 8 illustrates an alternative embodiment having 4 chip stacks in a two-by-two configuration. FIG. 9 illustrates an alternative embodiment having 4 chip stacks in an in-line configuration. FIG. 10 illustrates alternative embodiments of the ornamental design of the key. FIG. 11 illustrates one ornamental embodiment of the chip container having a logo on the top surface. FIG. 12 illustrates another ornamental embodiment of the chip container having a logo on the bottom surface.

In use, the chip container organizes game play around the simple rule of banking winnings. As a user wins during a gaming session, he or she deposits chips from his or her winnings into the chip container. Chips are retained in the chip container so that winnings are not gambled away. When the gambling session ends, chips are accessed by inserting a key and sliding out the chip tray.

The design and functionality described in this application is intended to be exemplary in nature and is not intended to limit the instant disclosure in any way. Those having ordinary skill in the art will appreciate that the teachings of the disclosure may be implemented in a variety of suitable forms, including those forms disclosed herein and additional forms known to those having ordinary skill in the art.

While certain embodiments of this disclosure have been described in connection with what is presently considered to be the most practical and various embodiments, it is to be understood that this disclosure is not to be limited to the disclosed embodiments, but on the contrary, is intended to cover various modifications and equivalent arrangements included within the scope of the appended claims. Although specific terms are employed herein, they are used in a generic and descriptive sense only and not for purposes of limitation.

This written description uses examples to disclose certain embodiments of the technology and also to enable any person skilled in the art to practice certain embodiments of this technology, including making and using any apparatuses or systems and performing any incorporated methods. The patentable scope of certain embodiments of the technology is defined in the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

The invention claimed is:

1. A lockable wagering chip container comprising:

a case comprising: a case top, a case bottom, two case sides, and two case ends, where the case top further comprises a through-hole and at least one of the two case ends is open;

a drawer comprising: a drawer top, a drawer bottom, two drawer sides, and two drawer ends, where the drawer top is open; the drawer bottom, two drawer sides, and two drawer ends partially enclose a drawer interior configured to hold a plurality of chips; and at least one of the drawer ends further comprises a chip slot configured to accept a chip inserted into the chip slot when the drawer is in a closed position; and a lock mechanism positioned within the case and configured to secure the drawer in the closed position until the lock mechanism is released by a key inserted into the through-hole.

2. The lockable wagering chip container of claim 1 where both case ends are open.

3. The lockable wagering chip container of claim 1 where each drawer end comprises a chip slot configured to accept a chip when the drawer is in a closed position.

4. The lockable wagering chip container of claim 1 where the chip slot configured to accept a chip when the drawer is in the closed position is further configured to prevent any chips from being removed when the drawer is in the closed position.

5. The lockable wagering chip container of claim 4 where the chip slot comprises at least one flexible finger, where the at least one flexible finger forms one edge of the chip slot;

the at least one flexible finger is configured so that the chip slot is smaller than a chip when the flexible finger is in an un-flexed state; and the at least one flexible finger is elastically deformed when a chip is inserted into the chip slot.

6. The lockable wagering chip container of claim 5 where the lock mechanism comprises:

a pocket located in the top of the case, having an open side which faces an interior of the case, and communicating with the through-hole;

a guide pin positioned in a guide-pin hole in the drawer bottom;

a spring aligned with the guide pin; and a plunger, aligned with the guide pin and the spring, where the plunger compresses the spring against the bottom of the drawer and the spring forces the plunger against the top of the case;

where, when the drawer is in the closed position, the spring forces the plunger into the pocket, securing the drawer in the closed position.

7. The lockable wagering chip container of claim 5 where the at least one flexible finger extends from a drawer wall.

8. The lockable wagering chip container of claim 7 where the chip slot comprises a second flexible finger which extends from a drawer wall.

9. The lockable wagering chip container of claim 8 where the flexible fingers extend from separate drawer walls and oppose each other.

10. The lockable wagering chip container of claim 8 where the drawer bottom further comprises at least one chip-extraction hole.

11. The lockable wagering chip container of claim 1 where the drawer bottom comprises a guide-pin hole.

12. The lockable wagering chip container of claim 11 where the lock mechanism comprises:

a pocket located in the top of the case, having an open side which faces an interior of the case, and communicating with the through-hole;

a guide pin positioned in the guide-pin hole;

a spring aligned with the guide pin; and a plunger, aligned with the guide pin and the spring, where the plunger compresses the spring against the bottom of the drawer and the spring forces the plunger against the top of the case;

where, when the drawer is in the closed position, the spring forces the plunger into the pocket, securing the drawer in the closed position.

13. The lockable wagering chip container of claim 12 where the pocket is centered on the through hole; and the guide pin and guide-pin hole align with the through-hole when the drawer is in the closed position.

14. The lockable wagering chip container of claim 11 further comprising:

an elongated guide-pin slot located in the bottom of the case, where the guide-pin slot is elongated in a direction in which the drawer opens and closes, is open to the drawer interior, and has closed ends;

a guide pin positioned in the guide-pin hole, where one end of the guide pin is positioned in the guide-pin slot; and where the interaction of the guide pin end with the ends of the guide-pin slot limits the travel of the drawer.

15. The lockable wagering chip container of claim 14 where the travel of the drawer is limited to allow access to one half of the drawer.

16. The lockable wagering chip container of claim 14 where the travel of the drawer is limited to a largest dimension of a single chip plus a thickness of an end wall of the drawer.

17. The lockable wagering chip container of claim 14 where the largest dimension of a single chip is a diameter.

* * * * *